US009473843B2

(12) United States Patent
Rasmussen et al.

(10) Patent No.: US 9,473,843 B2
(45) Date of Patent: Oct. 18, 2016

(54) INTEGRATED TUBE AND DOME FOR THIN TUBE BTE

(71) Applicants: Oticon A/S, Smørum (DK); Bernafon AG, Berne (CH)

(72) Inventors: Karsten Bo Rasmussen, Smørum (DK); Monika Bertges Reber, Heitenried (CH); Martin Lindebjerg, Smørum (DK)

(73) Assignees: OTICON A/S, Smorum (DK); BERNAFON AG, Berne (CH)

( * ) Notice: Subject to any disclaimer, the term of this patent is extended or adjusted under 35 U.S.C. 154(b) by 0 days.

(21) Appl. No.: 14/337,592

(22) Filed: Jul. 22, 2014

(65) Prior Publication Data

US 2015/0055809 A1 Feb. 26, 2015

(30) Foreign Application Priority Data

Aug. 22, 2013 (EP) ..... 13181282

(51) Int. Cl.
*H04R 25/00* (2006.01)
*H04R 1/10* (2006.01)

(52) U.S. Cl.
CPC ..... *H04R 1/1058* (2013.01); *H04R 25/652* (2013.01); *H04R 25/456* (2013.01); *H04R 25/658* (2013.01); *H04R 2225/021* (2013.01)

(58) Field of Classification Search
CPC .. H04R 25/65; H04R 25/652; H04R 25/656; H04R 25/658; H04R 1/1058; H04R 1/1016
USPC ..... 381/326, 324, 328, 380, 381; 181/129, 181/130, 135
See application file for complete search history.

(56) References Cited

U.S. PATENT DOCUMENTS 5,201,007 A * 4/1993 Ward et al. ..... 381/328
5,606,621 A 2/1997 Reiter et al.

(Continued)

FOREIGN PATENT DOCUMENTS

DE 202010009817 U1 10/2010
DE 202010009817 U1 * 10/2010

(Continued)

OTHER PUBLICATIONS

European Search Report, issued in EP 13181282, dated Jan. 10, 2014.

*Primary Examiner* — Sunita Joshi
(74) *Attorney, Agent, or Firm* — Birch, Stewart, Kolasch & Birch, LLP

(57) ABSTRACT

The invention describes a hearing device with a BTE (Behind-The-Ear) unit and an air filled tube. The BTE unit comprises a power source, a microphone, an amplifier, and a receiver and is configured to be mounted behind or on the ear of a user. The air filled tube as a proximal end and a distal end. The proximal end of the air filled tube is connected to the receiver of the BTE unit and a flexible sealing part is provided at the distal end. The flexible sealing part comprises a core hole permeable for sound transmitted from the air filled tube through a core pathway. The air filled tube is further configured to be arranged in a user's ear canal to transmit sound generated by the BTE unit to a tympanic membrane of the user. The flexible sealing part is arranged in a bony portion of the user's ear canal when in use. The diameter of the flexible sealing part is at least as large as the diameter of the bony portion of the ear canal of a user to close the ear canal.

28 Claims, 8 Drawing Sheets

(56) References Cited

U.S. PATENT DOCUMENTS

| | | | | |
|---|---|---|---|---|
| 6,137,889 | A | 10/2000 | Shennib et al. | |
| 7,027,608 | B2 * | 4/2006 | Fretz et al. | 381/330 |
| 2004/0165742 | A1 * | 8/2004 | Shennib | H04R 25/456 381/326 |
| 2008/0123889 | A1 | 5/2008 | Caldarola | |
| 2009/0097681 | A1 * | 4/2009 | Puria | H04R 25/405 381/318 |

FOREIGN PATENT DOCUMENTS

| | | | |
|---|---|---|---|
| EP | 0997057 | B1 | 12/2006 |
| FR | 2634645 | A1 | 2/1990 |
| GB | 962780 | A | 7/1964 |
| WO | WO 97/45074 | A1 | 12/1997 |
| WO | WO 01/50815 | A1 | 7/2001 |
| WO | WO 2010/077781 | A2 | 7/2010 |

* cited by examiner

INTEGRATED TUBE AND DOME FOR THIN TUBE BTE

The present invention concerns a hearing device comprising a BTE (Behind-The-Ear) unit, which is adapted to be mounted behind or on the ear of a user and further comprising an air filled tube, which comprises a bony seal part.

There exist many different types of conventional hearing devices, for example ITE (In-The-Ear), ITC (In-The-Canal), CIC (Completely-In-the-Canal) and BTE (Behind-The-Ear), which are characterized by the way they are fitted to the ear of a user, see for example US 2008/0123889 and references therein. The components of the first three types are mainly located in the ear or ear canal of the user. The BTE hearing device is mounted behind or on the ear of a user. It typically comprises a power source, a microphone, an amplifier and a receiver (speaker), which is connected to an air filled tube that has a distal end that can be fitted in the ear canal of the user. Sound generated by the receiver can be transmitted through the air filled tube to a tympanic membrane of a user's ear canal.

A major problem for hearing device users is the occurrence of various acoustic effects when using a hearing device, e. g., comb filter effect, sound oscillations or occlusion. The comb filter effect result through the simultaneous occurrence of device generated and natural sound in the ear canal of the user. Sound oscillations are generated in the device through sound reflections off the ear canal to the microphone of the hearing device. The occlusion corresponds to an amplification of a person's own voice when the person's ear canal is blocked. Especially occlusion is a well known issue for hearing device users. In the prior art the occlusion was avoided by not completely closing the ear canal, e. g., by applying open dome solutions, by using ear canal molds or ITE hearing instruments with large vent openings. Vent openings, however, lead to feedback problems known as "howling", where the hearing instrument emits a characteristic noise often with pure tone content. Avoiding the howling by anti-feedback processing results in deteriorated sound quality in situations where high amplification. The occlusion can, however, be avoided almost entirely by means of hearing devices which interface with the ear canal in the deeper bony portion of the ear canal.

GB 962,780 presents a deaf aid with a microphone disposed on the ear. The microphone is constructed so as to be accommodated in the external auditory meatus (ear canal), while amplifier parts are arranged behind the ear. The shape of the microphone is adapted to the shape of the external auditory meatus.

In U.S. Pat. No. 5,201,007 an earmold and a method of manufacturing an earmold for a hearing aid is presented. The earmold includes an acoustic conduction tube with a flexible flanged tip, e. g., a disk that exerts negligible pressure on the wall of the ear canal when in use. The disk of the acoustic conduction tube is at least as deep in the ear canal as the osseous portion (bony portion) of the ear canal when in use and conforms to the ear canal. The disk can have one or more vent holes.

WO 97/45074 A1 shows a thin diaphragm for contacting an individual's tympanic membrane which is used as a hearing improvement device. The diaphragm is sufficiently efficient to vibrate in response to sound stimuli so as to displace the tympanic membrane when in use. The edge of the diaphragm can be attached to a holder by a compliant member. The holder serves to hold the diaphragm against the tympanic membrane and can for example be a horn, a bumper, an adhesive or a clamp.

U.S. Pat. No. 6,137,889 presents a device to be worn in the ear of a subject with a vibrationally conductive assembly to provide a direct vibrational drive to the tympanic membrane. The device includes a vibratory transducer positioned within the ear canal proximal to the tympanic membrane. The vibratory transducer vibrates a thin elongate vibrationally conductive member, such as a filament, that is coupled to the tympanic membrane via a tympanic coupling element. The device can be a hearing aid.

In WO 01/50815 A1 a canal hearing device with a subminiature filament assembly to vibrate and drive the tympanic membrane is presented. The filament assembly is dynamically coupled to a stationary vibration force element positioned in the ear canal at a distance from the tympanic membrane when in use. The filament assembly comprises a vibratory element to respond to dynamic forces imparted by the vibrational force element and a vibrational shaft element for transferring audible vibrations from the vibratory element to the tympanic membrane, when in use.

US 2004/0165742 A1 shows a canal hearing device with a main module, a tubular insert, a sound conduction tube, a primary seal and a secondary seal. The main module is positioned in the cartilaginous region of the ear canal and axially and removably connected to the tubular insert. The tubular insert comprises the sound conduction tube and the cylindrically hollow primary seal, which is medially positioned in the bony region. The secondary seal is laterally positioned in the cartilaginous region to provide an additional acoustic sealing. The secondary seal is sufficiently vented to provide a path of least acoustic resistance for occlusion sounds within the ear canal. The tubular insert can comprise a coiled skeletal frame.

WO 2010/077781 A2 presents a hearing aid transducer. The transducer is configured to adapt itself to variations in the surface of a tympanic membrane and to slide over the migrating membrane without lubrication. The hearing aid transducer comprises a biocompatible carrier and a driving element attached to the carrier. The carrier has a surface which is shaped to fit a tympanic membrane or ear canal. The surface supports a plurality of microscopic setae. The driving element can receive electrical power from a photovoltaic cell.

U.S. Pat. No. 5,606,621 shows a hybrid BTE and CIC hearing aid with a BTE component and a CIC component. The BTE component is worn behind the ear of a patient and contains a microphone, a battery and amplifier circuitry. The CIC component is worn in the bony portion of the ear canal of the patient and contains the hearing aid receiver, which is connected to the amplifier means. The receiver of the CIC component is connected to the BTE component by a thin flexible wire cable.

EP 0997057 shows a BTE hearing aid wherein a very thin air filled tube with a diameter of less than 0.9 mm is provided for feeding sound from the receiver and into the ear.

The object of the present invention is to provide an improved hearing device.

The present invention provides a hearing device comprising a BTE (Behind-The-Ear) unit, and an air filled tube. The BTE unit comprises a power source, a microphone, an amplifier, and a receiver and is configured to be mounted behind or on the ear of a user. The air filled tube has a proximal end and a distal end. The proximal end of the air filled tube is connected to the receiver of the BTE unit and at least one flexible sealing part is provided at the distal end. The flexible sealing part comprises at least one core hole permeable for sound transmitted from the air filled tube through a core pathway. The air filled tube is configured to be arranged in a user's ear canal to transmit sound generated by the BTE unit to a tympanic membrane of the user. The at least one flexible sealing part is adapted to be arranged in a bony portion of the user's ear canal and its diameter is adapted to at least have the same diameter as the bony part diameter of the ear canal of a user to close the ear canal of the user.

One aspect of the invention is to reduce the occlusion effect by inserting a sealing part deep into the ear canal to the bony portion. Another aspect is the reduction of other acoustic effects, e. g., sound oscillations or the comb filter effect, as the sealing part closes the ear canal and sound cannot enter or escape the ear canal or the sound that enters or escapes the ear canal is dampened. The microphone is arranged on the BTE unit, therefore backscattered sound from the ear canal will reach the microphone with a significantly reduced sound pressure level compared to ITC, ITE and CIC devices. The hearing device is effective and easy to produce since no wires are needed inside the air filled tube. Another aspect of the invention is that the receiver (speaker) is protected in the BTE unit, which makes the device easy to maintain. The in-the-ear-canal part of the hearing device can have a smaller dimension, since it does not contain electrical parts. This increases the design freedom and allows the device to be useable for a higher number of different ear canal sizes and shapes, in which the sealing part can be physically conformed. The audiological fitting range can be high due to the absence of a vent channel. The flexible sealing part in the bony portion of the ear canal allows a more efficient noise reduction and a higher directionality to be experienced by the user, as all sound is generated from signals in a signal processing path, which may also be controlled by suitable processing schemes. Especially users with ski slope losses, which are users that are seriously impaired for high frequencies but have a normal hearing for low frequencies and experienced users, who want a good sound quality and need effective noise reduction in order to improve their speech understanding in noise situations benefit from the improved noise reduction efficiency. The invention is also especially advantageous for external signal sources such as sound from TVs, cell phones, or the like, as no or nearly no destructive interference between direct sound and amplified sound occurs.

In a preferred embodiment the flexible sealing part is a soft interchangeable dome shape seal, which is connected to the distal end of the air filled tube. The distal end of the air filled tube can also be formed in a dome shape seal. In an alternative embodiment the air filled tube contains several seals. In another embodiment the sealing part can also be an individually shaped ear canal mold, which is formed into the shape of an individual user's ear canal. Preferably the ear canal mold is connected to the distal end of the air filled tube. The distal end of the air filled tube can also be formed into an individually shaped ear canal mold. The ear canal mold is preferably covered in a soft material or made of a soft material to conform to the ear canal of a user and to prevent discomfort. Further the air filled tube can also be an interchangeable tube. The ear canal mold and dome shape seals can also be combined, for example in a coaxial or axially aligned arrangement on the air filled tube.

Preferably the flexible sealing part is of a soft material. More preferably the part of the flexible sealing part which is in contact with the bony portion of the ear canal, when the sealing part is in use, is of a very soft material to prevent injuries of the sensitive skin of the ear canal, especially for deep insertion of the flexible sealing part in the bony portion of the ear canal. Most preferably the material of the flexible sealing part is adapted to conform to the form of the ear canal.

In a preferred embodiment the air filled tube is of a material that is rigid enough as to allow for insertion of the air filled tube into the ear canal without the need of further means of insertion. Preferably the air filled tube is soft enough to allow for conformation of the tube to the ear and ear canal of a user.

The distal end of the air filled tube is preferably connected to the flexible sealing part in such a way, that the flexible sealing part stays connected to the air filled tube when the air filled tube is inserted or withdrawn from the ear canal of a user. The connection between the air filled tube and the sealing part can be primarily mechanical or primarily chemical. Preferably one interface section of the air filled tube is connected to an interface section of the sealing part. The interface of the interface sections can be connected primarily mechanically or primarily chemically. The type of connection is preferably chosen in dependence of the material choice and the physical shape of the interface between the two materials.

In a preferred embodiment the air filled tube is of a first material and the sealing part of a second material. The two materials can have different mechanical properties. Preferably the first material is more rigid than the second material and the second material is softer than the first material. The air filled tube and the flexible sealing part, e. g., a dome, can be cast by means of 2 k technology. In one embodiment the two different materials are cast in a two-shot molding process to produce the air filled tube and the flexible sealing part. Alternatively the two different materials can also be cast by overmolding. In a preferred embodiment the flexible sealing part is a dome of TPE (thermoplastic elastomer), silicone or materials with similar properties. The tube can be made of PEBA (polyether block amide), PEBAX or similar TPE (thermoplastic elastomer) or TPU (thermoplastic polyurethane) materials. In one embodiment the tube and sealing part are virtually inseparable due to a strong mechanical and/or chemical bond between them.

The hearing device can have one or more optional sealing parts on the portion of the air filled tube, that is inserted into the ear canal of the user. Preferably the optional sealing parts are included on the surface of the air filled tube that is in the cartilaginous region of the ear canal. The optional sealing parts can be optional seals connected to the air filled tube or they can also be part of the air filled tube formed into an optional sealing part. The optional sealing parts can for example have a dome shape, prong shape perpendicular to the tube axis or similar shapes that can be used to position the air filled tube in the ear canal, e. g., in the center of the ear canal. As an option the air filled tube can contain randomly distributed soft prongs shaped on its surface to position the air filled tube in the center of the ear canal. Preferably the optional prongs are of a soft material. The optional prongs can include holes for venting.

In a preferred embodiment the flexible sealing part has one or more prongs on its surface, which in use of the flexible sealing part face in the direction of the tympanic membrane. Preferably the prongs serve to prevent contact between the sealing part and the tympanic membrane, which can cause discomfort for the user. In one embodiment the contact between prongs and tympanic membrane can be felt by the user, which serves as a warning for the user. Alternatively an alarm can be sounded when the prong is deformed due to contact with the tympanic membrane, for example by piezoelectric properties of the prong material which induces a current to activate an alarm due to the deformation. The prongs are preferably of a very soft material that is at least softer than the tympanic membrane to prevent hurting the tympanic membrane. The prongs can have lengths between 0.1 mm and 10 mm, such as between 0.5 mm and 7.5 mm and preferably between 1 and 5 mm. The different prongs can have different lengths. Preferably the lengths of the prongs are equal for all prongs. The prongs are preferably scattered over the surface of the flexible sealing part in a symmetric way. The prongs can also be randomly scattered on the surface of the flexible sealing part. In a preferred embodiment the flexible sealing part is a dome shape seal with prongs.

The prongs can also be intended to make contact with the tympanic membrane when in use. In one embodiment the flexible sealing part is configured to serve as a synthetic tympanic membrane by vibrating though the sound transmitted through the air filled tube. The prongs on the surface of the vibrating flexible sealing part can be used to transmit the vibrations directly on certain parts of the tympanic membrane.

The prongs may alternatively be used to get an estimate about the insertion. An insert procedure could thus follow these steps: firstly a tool (possibly the ear insert with prongs) is used to measure the minimum ear canal depth, by insertion till it touches the tympanic membrane; then the prongs are cut 2 mm shorter than the insertion depth measured; correct insertion is verified by use of 2 mm shorter cut off length and the dome size as information to a simulation of the residual volume in a software simulator—this allows to precisely calculate the required gain for a specific ear.

A further way of insertion depth measurement and verification, is to use a beep sound, which could be used to get a good modeling for the residual volume.

In another embodiment the distal end of the air filled tube is formed by a core frustum. Also the proximity of the distal end of the air filled tube can be part of the frustum. Preferably a core pathway of the frustum is permeable for sound transmission. The frustum can for example be a clipped cone, a clipped pyramid, a horn or a similar frustum form or have a form of the aforementioned frusta. The form of the core frustum preferably increases high frequency sound transmission from the air filled tube. The distal end of the air filled tube can also be formed as a cylindrical opening.

The flexible sealing part can have an asymmetric shape. Preferably the asymmetric shape is adapted to account for the skewness of the boundary between hard and soft tissue between the bony portion and a cartilaginous portion of the ear canal. The material of the flexible sealing part can partly or entirely be permeable for sound transmission, it can for example be a porous material, a grating, contain small holes or the like. The material of the flexible sealing part can also be permeable for gas and/or fluids.

The core pathway of the air filled tube can contain a wax filter element, which can block cerumen (ear wax) from entering the core pathway of the air filled tube. Preferably the wax filter element is a grating or similar means for blocking cerumen that is placed at the distal end of the air filled tube.

The air filled tube may be a thin tube such as a tube having an inner diameter of no more than 1.3 mm or nor more than 0.9 mm. These thin tubes are in-conspicuous, and well liked by the users however requires special sound processing by the sound signal processor of the hearing aid. The diminished air volume will help alleviate the problem of acoustic high frequency attenuation due to the relatively thin tubing, compared to traditional BTE tubing. The smaller volume will create more high frequency response, typically in the order of 10 dB for some frequencies, than for a traditional fitting anchored further out in the ear canal. The electronic amplification for high frequencies should therefore be reduced accordingly in order to obtain the same end result. This will result in that the audiological fitting range may be increased.

Another factor is that for a closed dome or similar, such as a bony seal, all the sound is passing through the hearing instrument, as there is little or no vent channel to pass directly from the sound source in the surrounding to the tympanic membrane, and therefore a higher time delay through the signal processing may be allowed without audible disturbances to the user. Such disturbances are usually perceived or measured as comb filter problems, and stems from interaction between sound passed through a vent and amplified sound. Without such a problem delay times of up to 10-12 milliseconds may be permitted.

The signal processing could therefore be optimized for increased fitting range taking less electronic high frequency amplification into account and permitting delay times up to 10-12 milliseconds.

The present invention will be more fully understood from the following detailed description of embodiments thereof, taken together with the drawings in which.

Figure 1:
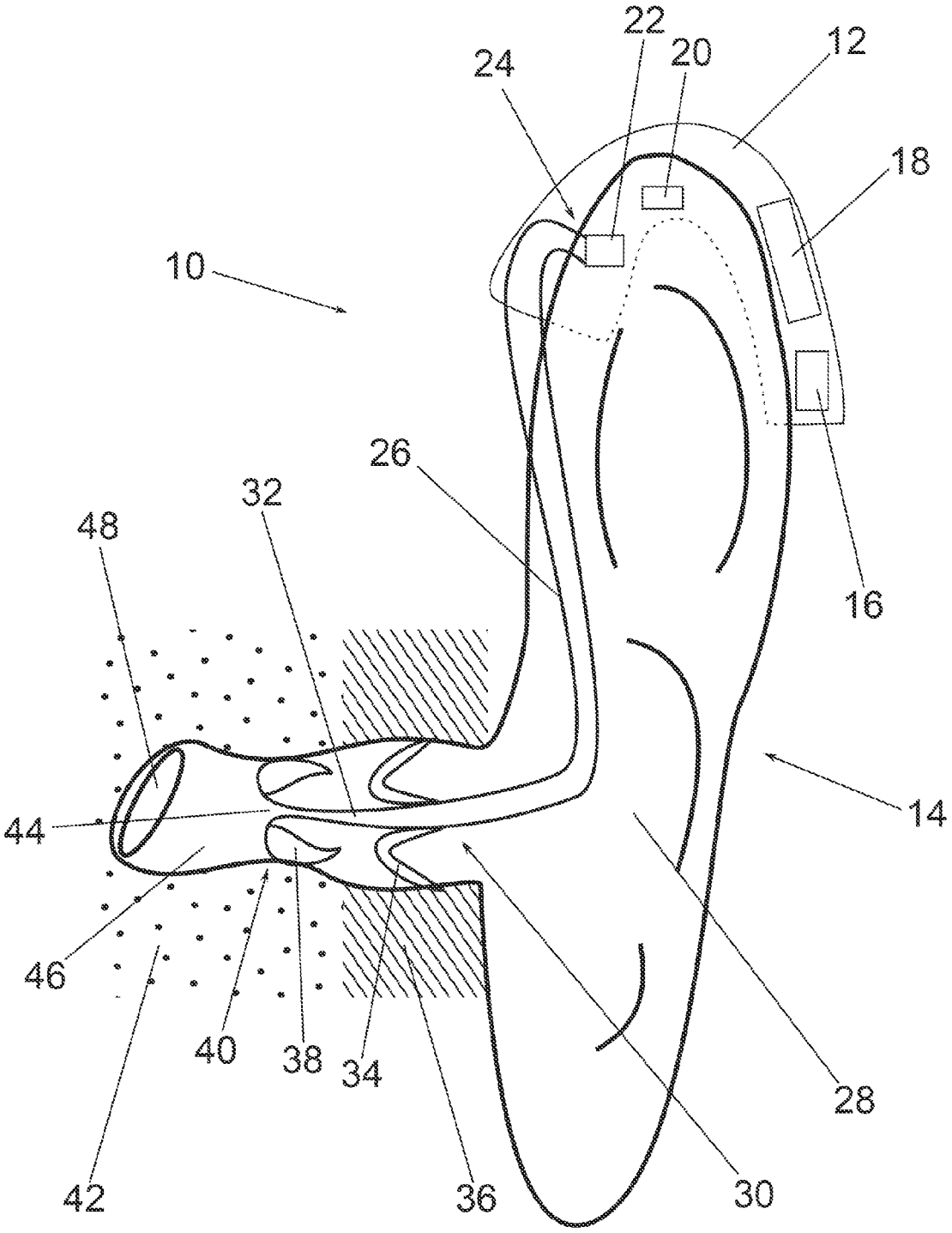
FIG. 1 shows a schematic illustration of a human ear with a mounted hearing device with a BTE (Behind-The-Ear) unit connected to an air filled tube that is inserted into the ear canal of the human ear.

FIG. 1 shows a hearing device 10 with a Behind-The-Ear (BTE) unit 12 mounted behind an ear 14 of a user. The BTE unit 12 has a microphone 16, a power source 18, an amplifier 20 and a receiver 22. The microphone 16 records sound from the environment and generate electrical signals to encode the sound. The amplifier 20 amplifies the electrical signals and processes them, for example by amplification of certain frequencies individualized to the hearing device user, by reduction of background noise, by adaption of listening environment, by improvement of spatial hearing, by transposition of frequencies or the like. The amplified and processed signals are transmitted to the receiver 22, where sound is generated from the electrical signals. The receiver is acoustically connected to a proximal end 24 of an air filled tube 26. The air filled tube 26 runs along the form of the ear 14 through the concha 28 into the ear canal 30. The core pathway 32 enclosed by the air filled tube 26 guides the sound generated by the receiver 22 from the BTE unit 12 into the ear canal 30. In this embodiment the air filled tube 26 is positioned in the center of the ear canal 30 with the help of an optional seal 34, which adjoins to the cartilaginous portion 36 of the ear canal 30. A flexible sealing part 38 at the distal end 40 of the air filled tube 26 adjoins to a bony portion 42 of the ear canal 30, which forms roughly the innermost third of the ear canal 30 and closes the ear canal 30 to prevent escape of sound. Preferably the flexible sealing part 38 has at least the same diameter as the bony portion 42 of the ear canal of the user. The sound is transmitted through the core pathway 32 to a sound permeable core hole 44 of the flexible sealing part 38 which is in contact with the ear canal cavity 46 that contains a tympanic membrane 48 at its distal end. The sound reaching the tympanic membrane 48 causes the tympanic membrane 48 to oscillate which ultimately allows to convert and amplify vibrations in air (sound) to vibrations in fluid in the fluid-filled cochlea, where the vibrations are transformed into electrical signals to be processed for the auditory perception of the user (not shown).

Figure 2:
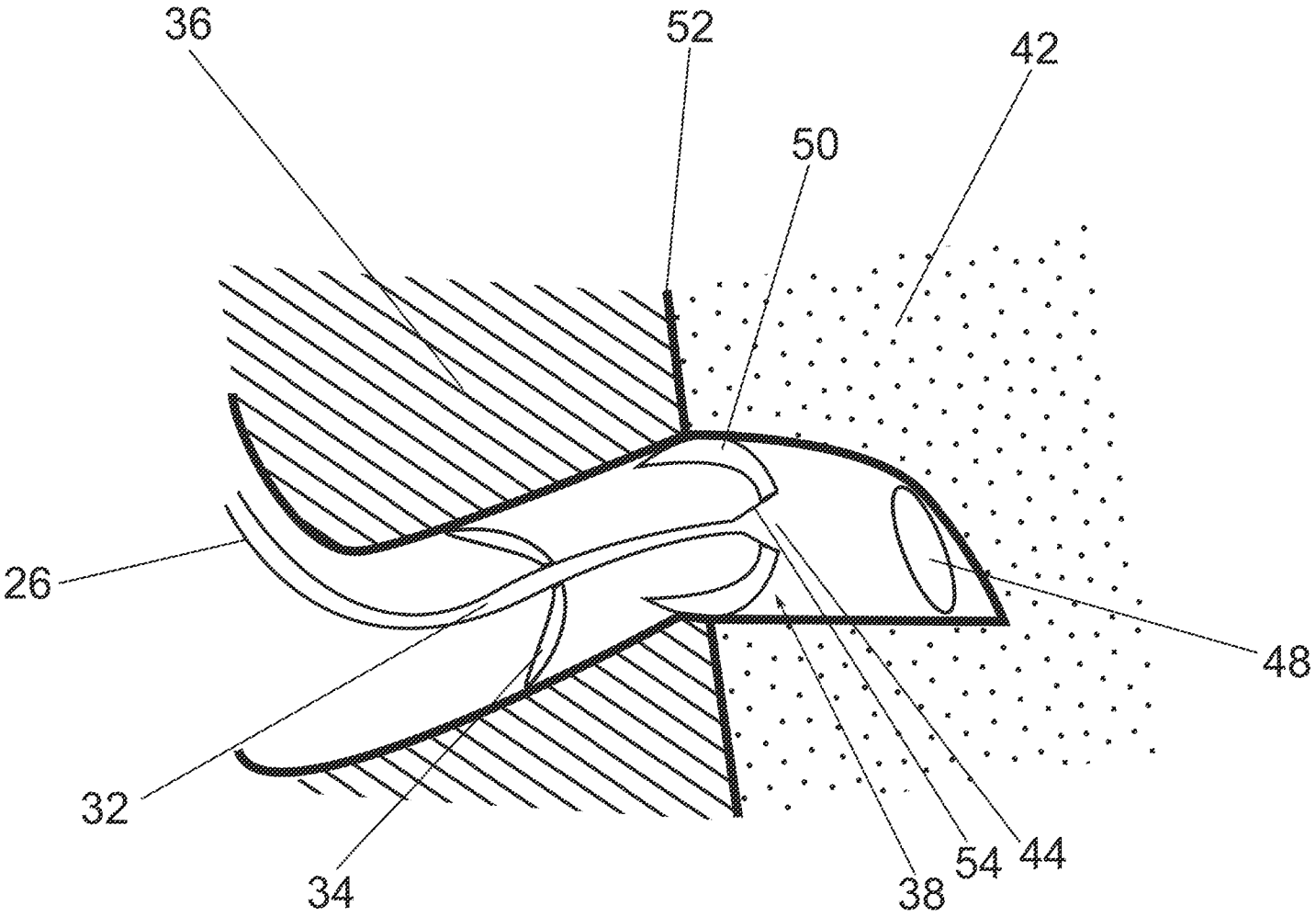
FIG. 2 shows a schematic illustration of an embodiment of an air filled tube connected to an embodiment of a flexible sealing part in the ear canal of the human ear.

FIG. 2 shows an embodiment of the air filled tube 26 with the optional seal 34 and the sealing part 38 in the ear canal 30. The optional seal 34 adjoins the wall of the cartilaginous portion 36 of the ear canal 30 and positions the air filled tube 26, for example in the center of the ear canal 30. The optional seal 34 can be an optional sealing part that is formed by a part of the air filled tube 26 or it can be connected to the air filled tube 26. The flexible sealing part 38 is in contact with the bony portion 42. Preferably the flexible sealing part 38 which is in contact with the bony portion 42 is at least partly of a very soft material which conforms to the form of the ear canal 30. A soft interchangeable dome shape seal 50 of the flexible sealing part 38 extends partly over the cartilaginous to bony boundary 52 and adjoins to the wall of the ear canal 30 to close it. The dome shape seal 50 can be connected to the distal end 40 of the air filled tube 26 or form the distal end 40 of the air filled tube 26. The dome shape seal 50 can also be the flexible sealing part 38. The sealing part 38 can also be located deeper in the bony portion 42 (not shown). Sound generated from the BTE unit 12 is transmitted trough the core pathway 32 to the sound permeable core hole 44, which is shaped in form of a frustum 54 to increase high frequency sound transmission through the air filled tube 26 to the tympanic membrane 48. The frustum 54 can for example have a form of a clipped cone, a clipped pyramid, a horn or a similar frustum form.

Figure 3:
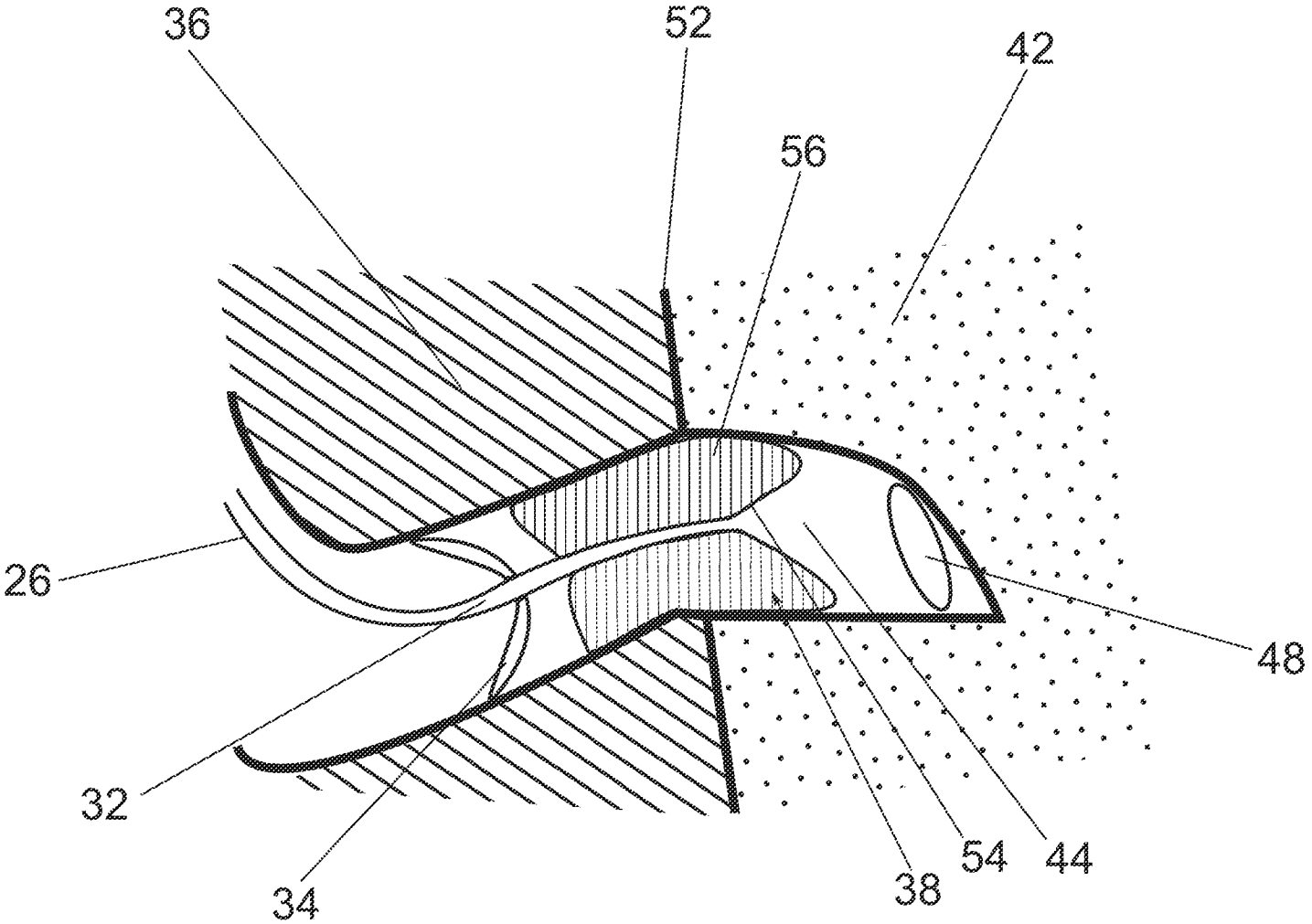
FIG. 3 shows a schematic illustration of an embodiment of an air filled tube connected to an embodiment of an ear canal mold in the ear canal of the human ear.

FIG. 3 shows an embodiment of the air filled tube 26 with the optional seal 34 and the sealing part 38 in form of an individually shaped ear canal mold 56 in the ear canal 30. The ear canal mold 56 conforms to the ear canal 30 of the user. Preferably the ear canal mold 56 is covered by a soft material (not shown). The ear canal mold 56 can be connected to the air filled tube 26 or form the distal end 40 of the air filled tube 26. The flexible sealing part 38 can also be a combination of an ear canal mold 56 and another seal or sealing part, e. g., a dome shape seal 50 (not shown). Otherwise the embodiment of FIG. 3 is equivalent to the embodiment presented in FIG. 2.

Figure 4:
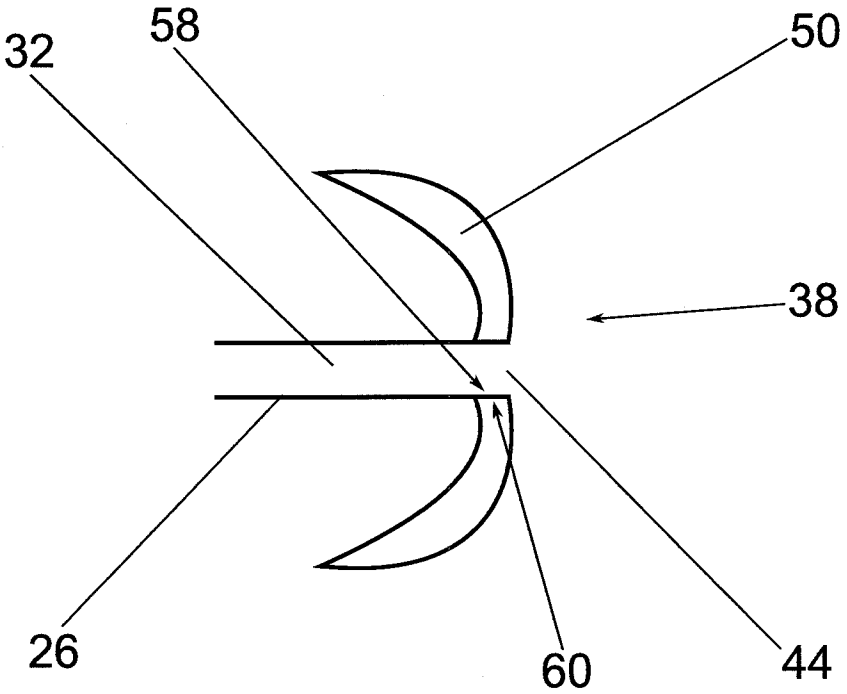
FIG. 4 shows a first embodiment of a flexible sealing part connected to the air filled tube.

FIG. 4 shows a schematic illustration of a first embodiment of the flexible sealing part 38 with a dome shape seal 50. An interface section 58 of the air filled tube 26 is connected with an interface section 60 of the dome shape seal 50 located next to the core hole 44. The core hole 44 is formed in a cylindrical shape in this embodiment. The core hole 44 can also be shaped in the form of a frustum 54. Preferably the connection between the interface section 58 and 60 is primarily mechanical or primarily chemical in dependence of the material and shape of the interface sections 58 and 60. The connection between the flexible sealing part 38 and the air filled tube 26 is preferably strong enough to withstand the process of inserting and withdrawing the air filled tube 26 into the ear canal 30 of a user, without falling off of the flexible sealing part 38 to prevent that the flexible sealing part 38 remains in the ear canal 30.

The air filled tube 26 and the flexible sealing part 38 can be of two different materials. Preferably the two different materials have different mechanical properties. The material of the air filled tube 26 is preferably more rigid than the material of the flexible sealing part 38. The first material can for example be PEBA (polyether block amide), PEBAX or similar TPE (thermoplastic elastomer) or TPU (thermoplastic polyurethane) materials. The second material can for example be TPE, silicone or the like. The material of the air filled tube 26 is preferably rigid enough as to allow for insertion of the air filled tube 26 into the ear canal 30 without the need of further means of insertion (not shown). The material of the air filled tube 26, however, is preferably also flexible enough to at least partly conform to the shape of the ear 14 and the ear canal 30, which allows the air filled tube 26 to be inserted into the ear canal 30 without hurting the wall of the ear canal 30. The two different materials for the air filled tube 26 and the flexible sealing part 38 can for example be cast in a two-shot molding process or an overmolding process.

Figure 5:
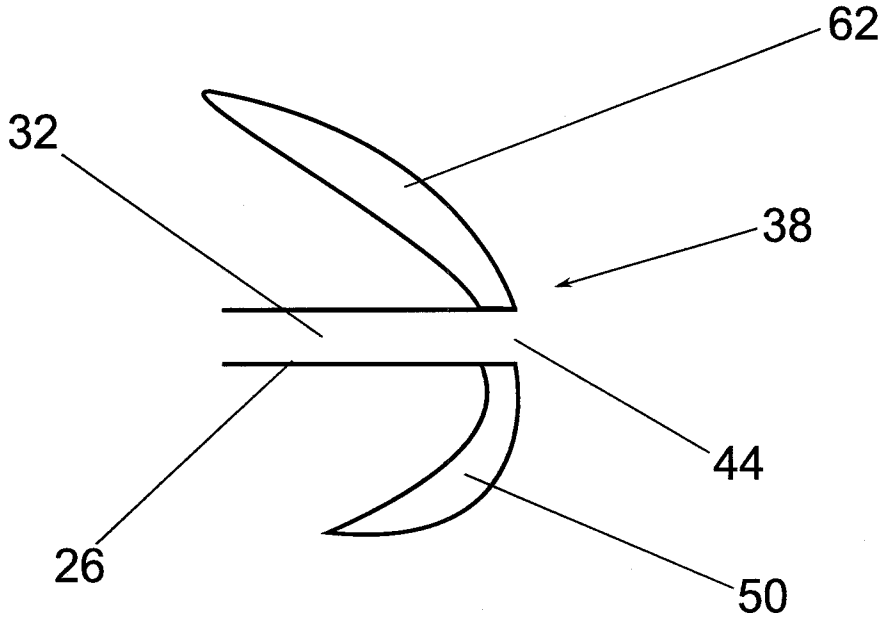
FIG. 5 shows a second embodiment of a flexible sealing part connected to the air filled tube.

FIG. 5 shows a schematic illustration of a first embodiment of the flexible sealing part 38 with a dome shape seal 50 and an asymmetric dome shape part 62. The asymmetric dome shape part 62 accounts for the skewness of the boundary 52 between hard and soft tissue between the bony portion 42 and the cartilaginous portion 36 of the ear canal 30. The asymmetric dome shape part 62 is preferably connected to the remaining dome shape seal 50. In an alternative embodiment a small slit can exist on the circumference of the dome shape seal 50 which divides the dome shape seal 50 part from the asymmetric dome shape part 62 and which can for example be used for venting. Otherwise the embodiment of FIG. 5 is equivalent to the embodiment presented in FIG. 4.

Figure 6:
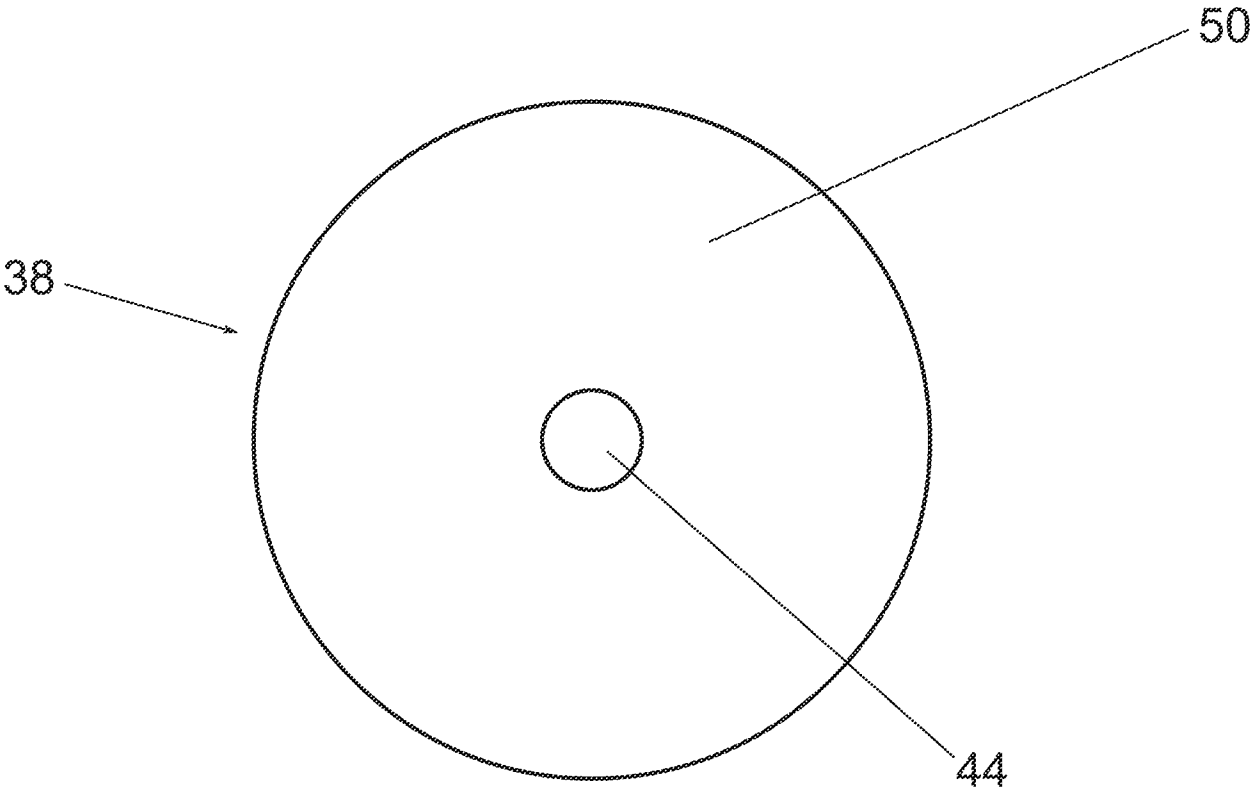
FIG. 6 shows a schematic illustration of the first embodiment of the flexible sealing part as seen from the tympanic membrane.

FIG. 6 shows a schematic illustration of the first embodiment of the flexible sealing part 38 as seen from the tympanic membrane 48 when inserted into the ear canal 30. The flexible sealing part 38 has a dome shape seal 50 with a core hole 44 in its center.

Figure 7:
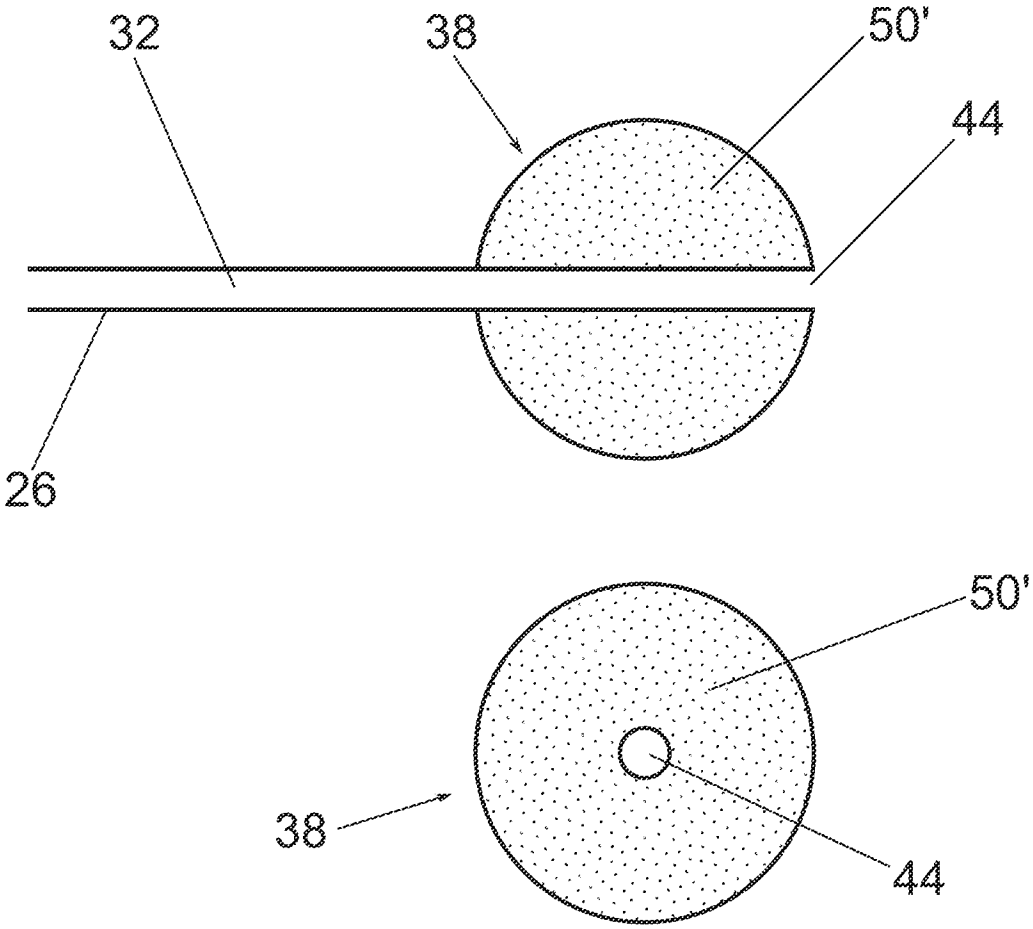
FIG. 7 shows another embodiment of the flexible sealing part.

FIG. 7 shows another embodiment of the flexible sealing part 38 connected to the air filled tube 32. The flexible sealing part 38 has a spherically shaped dome shape seal 50', which comprises a porous material or is made of a porous material. The porous material is partly permeable for sound transmission and allows for transmission of sound from the ear canal 30 to the outside of the ear 14 and vice versa (not shown). The sound from the BTE unit 12 is transmitted by the core pathway 32 enclosed by the air filled tube 26, which ends at the core hole 44, which in use is arranged in the ear canal cavity 46 in front of the tympanic membrane 48 (not shown). The core hole 44 can contain a wax filter element that can block cerumen (ear wax) from entering the air filled tube 26 as an option.

Figure 8:
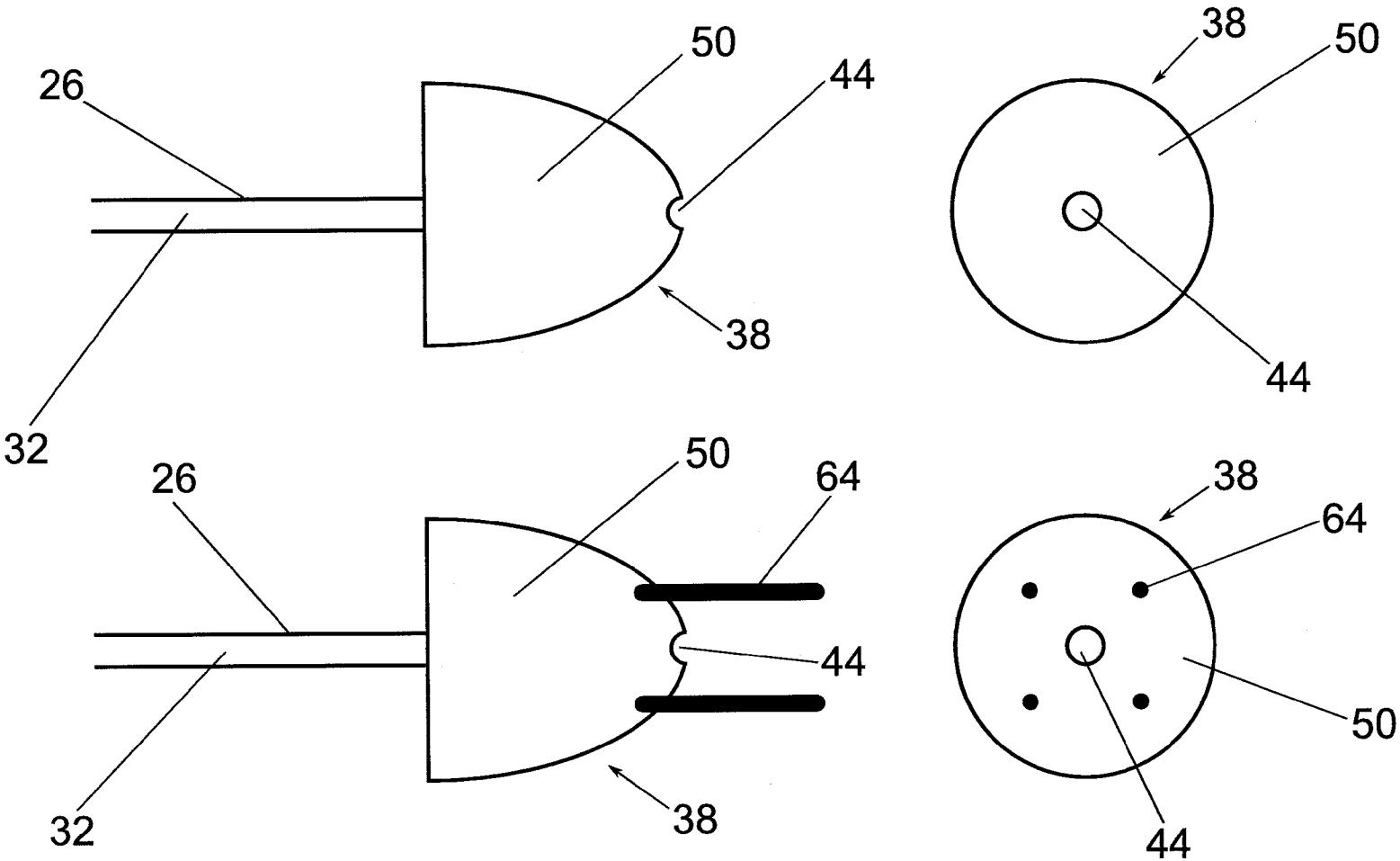
FIG. 8 shows two perspectives and two embodiments of a flexible sealing part with one of the embodiments including prongs.

FIG. 8 shows two embodiments of the flexible sealing part 38 connected to the air filled tube 26. The first embodiment has a flexible dome shape seal 50 connected to the distal end 40 of the air filled tube 26. The distal end 40 of the air filled tube 26 can also be formed into the dome shape seal 50 and therefore be a dome shape part of the air filled tube 26. The second embodiment includes prongs 64 of a soft material, which are arranged on the surface of the dome shape seal 50. The prongs 64 face into the direction of the tympanic membrane 48 when the air filled tube 26 is inserted into the ear canal 30. Preferably the prongs are of a soft material that does not hurt or pierce through the tympanic membrane 48 when force is applied for the insertion process of air filled tube 26 into the ear canal 30. Therefore the prongs 64 can be used as a spacer between the tympanic membrane 48 and the flexible sealing part 38, which can be felt on the tympanic membrane 48, when the air filled tube 26 is inserted too deep into the ear canal 30.

The arrangement of the prongs 64 on the surface of the flexible sealing part 38 can be symmetric, asymmetric or random. Preferably the prongs 64 are closer to the center of the flexible sealing part 38 to avoid contact with the wall of the ear canal 30 during insertion of the air filled tube 26. The lengths of the prongs 64 can be identical for all prongs 64 or different. Preferably prongs 64 which are arranged closer to the center are longer than prongs 64 that are closer to the wall of the ear canal 30. The prongs 64 can have lengths between 0.1 mm and 10 mm, such as between 0.5 mm and 7.5 mm and preferably between 1 and 5 mm.

The prongs 64 can also contain means for producing an alarm sound or alarm signal when the prongs 64 get into contact with the tympanic membrane 48. For example the material can have piezoelectrical properties which lead to a current through the prongs 64 when the prongs 64 are deformed due to the contact with the tympanic membrane 48. The current through the prongs 64 can then be used to sound an alarm or send an electrical signal through a cable to the BTE unit 12, where an alarm sound can be generated by the receiver 22 and sent to the tympanic membrane 48 by the air filled tube 26 (not shown).

Alternatively the prongs 64 can also be in contact with the tympanic membrane 48 and guide vibrations generated at the distal end 40 of the air filled tube 26 to the tympanic membrane 48. In this case the distal end 40 of the air filled tube 26 is configured to convert sound into vibrations of the prongs 64, for example by a coupling element or by acting as a synthetic tympanic membrane (not shown).

REFERENCE SIGNS

10 hearing device
12 BTE (Behind-The-Ear) unit
14 ear
16 microphone
18 power source
20 amplifier
22 receiver
24 proximal end of air filled tube
26 air filled tube
28 concha
30 ear canal
32 core pathway
34 optional seal
36 cartilaginous portion
38 sealing part
40 distal end of air filled tube
42 bony portion
44 core hole
46 ear canal cavity
48 tympanic membrane
50 dome shape seal
52 cartilaginous to bony boundary
54 frustum
56 ear canal mold
58 interface section of air filled tube
60 interface section of flexible sealing part
62 asymmetric dome shape part
64 prong

The invention claimed is:

1. A hearing device, comprising:
a power source;
a microphone;
an amplifier; and
a receiver; and
at least one flexible sealing part provided at a distal end of the hearing device, wherein
the at least one flexible sealing part comprises at least one core hole permeable for sound transmitted from the receiver,
the at least one flexible sealing part includes one or more prongs on the surface of the flexible sealing part, said one or more prongs having an elongated shape extending in a direction toward the tympanic membrane when the at least one flexible sealing part is inserted into the user's ear canal and serving as a spacer between the tympanic membrane and the flexible sealing part, and
the at least one flexible sealing part is adapted to be arranged in a bony portion of the user's ear canal and the at least one flexible sealing part's diameter is adapted to at least have the same diameter as the bony portion's diameter of the ear canal of a user to close the ear canal of the user.

2. The hearing device according to claim 1, further comprising:
a BTE (Behind-The-Ear) unit configured to be mounted behind or on the ear of the user and housing the power source, the microphone, the amplifier, and the receiver;
an air filled tube having a proximal end and a distal end, wherein
the proximal end of the air filled tube is connected to the receiver of the BTE unit and said at least one flexible sealing part is provided at the distal end of the air filled tube, and
at least a part of the air filled tube is configured to be arranged in a user's ear canal to transmit sound generated by the BTE unit to a tympanic membrane of the user.

3. The hearing device according to claim 1, comprising an ITE hearing aid.

4. The hearing device according to claim 2, comprising a BTE hearing aid.

5. A hearing device according to claim 2, wherein
at least one of the flexible sealing parts is a soft interchangeable dome shape seal connected to the distal end of the air filled tube.

6. A hearing device according to claim 1, wherein
at least one of the flexible sealing parts is an individually shaped ear canal mold, which is adapted to be formed into the shape of an individual user's ear canal.

7. A hearing device according to claim 1, wherein
at least a part of the at least one flexible sealing part which in use is in contact with the bony portion of the ear canal is of a very soft material, which is adapted to conform to the form of the ear canal.

8. A hearing device according to claim 2, wherein
the material of the air filled tube is rigid enough as to allow for insertion of the air filled tube into the ear canal without the need of further means of insertion.

9. A hearing device according to claim 2, wherein
the distal end of the air filled tube is adapted to connect to the at least one flexible sealing part and wherein the connection between the air filled tube and the at least one flexible sealing part is strong enough to prevent falling off of the flexible sealing part during insertion and withdrawal of the air filled tube connected to the flexible sealing part in the ear canal.

10. A hearing device according to claim 2, wherein the air filled tube is of a first material and the flexible sealing part is of a second material and wherein the first material is more rigid than the second material and the second material is softer than the first material.

11. A hearing device according to claim 10, wherein the two different materials for the air filled tube and the flexible sealing part are cast in a two-shot molding process.

12. A hearing device according to claim 10, wherein the two different materials for the air filled tube and the flexible sealing part are cast in an overmolding process.

13. A hearing device according to claim 2, wherein an interface section of the air filled tube is primarily mechanically or primarily chemically connected to an interface section of at least one flexible sealing part.

14. A hearing device according to claim 2, wherein an additional sealing part is provided on the part of the air filled tube, which is configured to be inserted into an ear canal of the user and wherein the additional sealing part is adapted for positioning of the air filled tube in the ear canal.

15. A hearing device according to claim 1, wherein the prongs on the surface of the at least one flexible sealing part face in the direction of the tympanic membrane when in use.

16. A hearing device according to claim 2, wherein the distal end and the proximity of the distal end of the air filled tube are formed by a core frustum with the core pathway permeable for sound transmission.

17. A hearing device according to claim 1, wherein the flexible sealing part has an asymmetric shape part which is adapted to account for the skewness of the boundary between hard and soft tissue between the bony portion and a cartilaginous portion of the ear canal.

18. A hearing device according to claim 1, wherein the flexible sealing part is of a material that is at least partly permeable for sound transmission.

19. A hearing device according to claim 2, wherein the air filled tube is a thin tube with an internal diameter of no more than 1.3 mm or no more than 0.9 mm and an outer diameter of no more than 1.6 mm or less.

20. A hearing device according to claim 5, wherein at least one of the flexible sealing parts is an individually shaped ear canal mold, which is adapted to be formed into the shape of an individual user's ear canal and which is connected to the distal end of the air filled tube.

21. A hearing device according to claim 5, wherein at least a part of the at least one flexible sealing part which in use is in contact with the bony portion of the ear canal is of a very soft material, which is adapted to conform to the form of the ear canal.

22. A hearing device according to claim 6, wherein at least a part of the at least one flexible sealing part which in use is in contact with the bony portion of the ear canal is of a very soft material, which is adapted to conform to the form of the ear canal.

23. A hearing device according to claim 5, wherein the material of the air filled tube is rigid enough as to allow for insertion of the air filled tube into the ear canal without the need of further means of insertion.

24. The hearing device according to claim 1, comprising a hearing aid.

25. The hearing device according to claim 1, wherein the prongs are made of a material that induces a current in response to mechanical deformation of the prongs.

26. The hearing device according to claim 25, wherein the hearing device sounds an alarm in response to deformation of the one or more prongs.

27. The hearing device according to claim 1, wherein the prongs have lengths between 0.1 mm and 10 mm.

28. The hearing device according to claim 1, wherein the prongs are made of a material that is softer than the user's tympanic membrane.

* * * * *